US005422620A

United States Patent [19]

Bitterli

[11] Patent Number: 5,422,620

[45] Date of Patent: Jun. 6, 1995

[54] TRANSFORMER

[75] Inventor: Hanspeter Bitterli, Luzern, Switzerland

[73] Assignee: Susanne Riedi-Joks, Luzern, Switzerland

[21] Appl. No.: 415,270

[22] PCT Filed: Nov. 17, 1988

[86] PCT No.: PCT/CH88/00213

§ 371 Date: Aug. 6, 1992

§ 102(e) Date: Aug. 6, 1992

[87] PCT Pub. No.: WO89/06860

PCT Pub. Date: Jul. 27, 1989

[30] Foreign Application Priority Data

Jan. 14, 1988 [CH] Switzerland ..... 119/88

[51] Int. Cl.[6] ..... H01F 27/24

[52] U.S. Cl. ..... 336/211; 336/178; 336/189; 336/212; 336/215

[58] Field of Search ..... 336/178, 184, 211, 212, 336/215, 219

[56] References Cited

U.S. PATENT DOCUMENTS

| | | | |
|---|---|---|---|
| 1,662,132 | 3/1928 | Simmons . | |
| 2,780,786 | 2/1957 | Johnson | 336/212 |
| 3,268,843 | 8/1986 | Popp . | |
| 3,360,753 | 12/1967 | Wroblewski . | |
| 3,673,491 | 6/1972 | Baycura | 323/48 |
| 3,708,744 | 1/1973 | Stephens et al. | 323/60 |
| 4,075,547 | 2/1978 | Wroblewski | 323/60 |

FOREIGN PATENT DOCUMENTS

| | | |
|---|---|---|
| 912527 | 8/1946 | France . |
| 1588871 | 3/1970 | France . |
| 735778 | 5/1943 | Germany . |
| 1539555 | 5/1970 | Germany . |

*Primary Examiner*—Leo P. Picard
*Assistant Examiner*—L. Thomas
*Attorney, Agent, or Firm*—Evenson, McKeown, Edwards & Lenahan

[57] ABSTRACT

The so-called delta-phi transformer makes use of the effects of various core materials and air gap sections in the cores on the magnetization curves of core materials. It consists of at least two magnetically separated cores, designated source core SK and regulating core RK, which possess different magnetic properties. At least one coil A, the primary winding, is wound on the cores, which are thereby electrically coupled. Hence, both cores SK and RK are traversed by the same magnetic flux. As a result of their different magnetic properties, different magnetic fields are generated in the two cores SK and RK. A coil B is wound on the source core SK and a second coil is wound on the regulating core RK. Coils B and C are secondary windings and are designed to be connected in an additive or subtractive series circuit, depending on the desired variation in secondary voltage, or to be arranged in open circuit. Delta-phi transformers can also be connected to form delta-phi transformer systems which can function in primary, secondary or tertiary mode. By suitable design and connection of the individual delta-phi transformers, the magnitude of the secondary voltage can be varied as desired in function of the primary voltage.

14 Claims, 20 Drawing Sheets

TRANSFORMER

BACKGROUND OF THE INVENTION

The invention deals with a transformer for the transformation of the voltage of electrical energy of any frequency and curvature.

Transformers serve to transform the electrical energy of a certain voltage in that of a different voltage. They are therefore used in the entire field of electrical engineering and electronics. The fact that the electrical energy is mostly transformed three times, often even more frequently, on the long path from production to the consumer also shows the importance of the transformers for the supply of electrical energy. The technical and economical quality of the electricity supply is influenced to a decisive degree by their operational safety and their degree of efficiency. Under these circumstances, the development of transformer construction has been carried on to an extraordinarily large extent. The transformer is one of the operationally safest links in the systems of supply of electrical current. Principally, the transformer consists of an iron core and two coils, insulated against one another and the earth. The iron core is on the one hand the mechanical support of the coils and on the other it conducts the magnetic flux, which causes the transfer of the voltage from the one coil to the other. The coil to which the energy is fed is called the primary coil, and the coil from which the energy, reduced by the consumption of the transformer, is removed is called the secondary coil.

Due to the construction of the transformer, the relative secondary voltage fluctuation is exactly equal to the relative primary voltage fluctuation. When the transformer is put under load, the secondary no-load voltage decreases by the internal voltage drop, caused by the short-circuit impedance and the load current. The secondary voltage of the transformer is dependent upon the primary voltage fluctuation and the load. This state of affairs leads to the fact that the consumer voltage must be permanently regulated to a certain consumer voltage level of 400/231 Volt due to the permanent alternating loads in the distribution networks for electrical energy. This regulation is carried out with electromotively driven load increment switches on the high-voltage side in the sub-station transformers under load. This form of operation automatically results in enormous wear of the contact studs of the load increment switches, which means that they periodically have to be subjected to a costly inspection. On the one hand, the possible number of increments of the load increment switches is restricted for constructional and economical reasons, so that thus a relatively approximate regulation of the consumer voltage comes about, and on the other hand, the alteration of the load comes about relatively sensitively. These facts lead to the consumer operating voltage being fixed at 400/231 V, on average about 5% above the consumer voltage of 220/380 V, and permanently fluctuating within fixed limits. For the reason of the dimensioning of the electrical equipment, the latter have a fixed inner ohmic resistance or a fixed inner impedance. These facts lead to the equipment taking about 5% higher operational current from the consumer mains when connected to an excessive voltage of about 5% and thus causing about 10% over-consumption of electrical energy. Mainly, this is only converted into an unused excess heat due to energy losses, which has a negative effect on the operational efficiency and longevity of this equipment. Likewise, the voltage fluctuations and excessive voltage peaks which come about in highly sensitive plants such as computers, numerically controlled machines etc. during the phase switching are not desired and can thus have damaging or even catastrophic consequences. Conventional transformers are the causers of an approximately 10% higher consumption of energy and cause a multitude of problems which have to be solved, especially in the field of highly sensitive processor technology, which is becoming more and more widespread.

SUMMARY OF THE INVENTION

It is an object of the invention in question to provide a transformer or a system of transformers which solves the above mentioned problems. The transformer or system of transformers in accordance with this invention is to make the load increment switch in the sub-station transformers for distribution of electrical energy and the phase switching in other transformers for the same or a similar application superfluous. A further object of the invention is to provide a transformer, by means of which the unstable secondary or unstable consumer voltage of 400/231 Volt can be kept independent of load on the secondary or consumer nominal voltage of 220/380 V over a certain area of fluctuation of primary voltage from no-load to full load, or can be kept constant up to a certain overload independent of power factors in certain limits and independent of frequency in certain limits.

A further object of the invention is to provide a transformer, by means of which any determinable secondary voltage behaviour can be produced independent of and/or dependent on load within a certain area of primary voltage.

The invention solves these problems with a transformer, which is marked by the fact that it has at least two magnetically separated cores, each of which has differing magnetic characteristics in its total magnetic effect, whereby at least one coil encloses at least two of these cores and thus couples them electrically and at least one further coil encloses at least one core or additionally with at least one transformer which is marked by the fact that it has at least two magnetically separated cores, each of which has differing or identical magnetic characteristics in its total magnetic effect, whereby at least one coil encloses at least two of these cores and thus couples them and at least one further coil encloses at least one core.

Transformers and transformer systems in accordance with the invention are shown in principle in exemplary versions in the diagrams. The individual versions are for the creation of certain forms of behaviour of secondary voltage, either independent of and/or dependent upon load. Further, the physical background of its form of operations is made clear on the basis of various magnetization curves. In the following description, the basic construction and principle of functioning of the transformer and transformer system in accordance with the invention are explained. Further, the versions shown are described and the form of operation is explained. The transformer in accordance with the invention is referred to in the following as the delta-phi transformer and the transformer system in accordance with the invention as the delta-phi transformer system.

Figure 12:
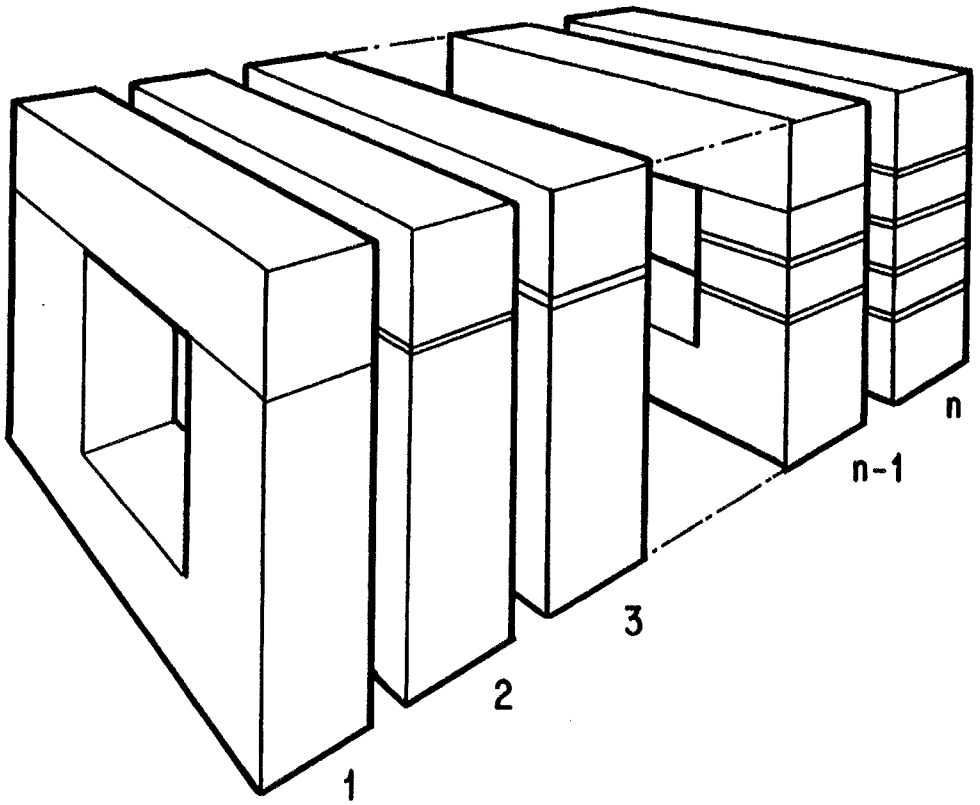
Figure 13A:
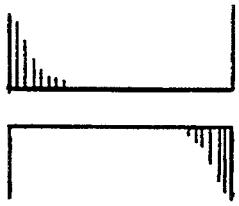
Figure 13B:
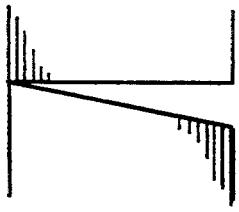
Figure 13C:
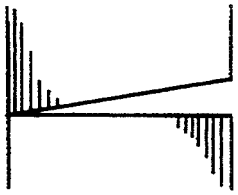
Figure 13D:
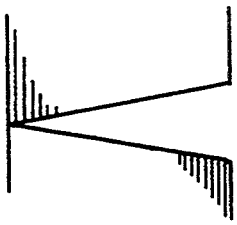
Figure 13E:
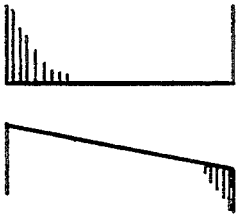
Figure 13F:
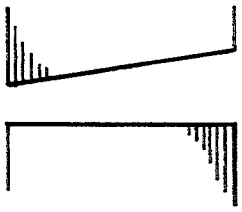
Figure 13G:
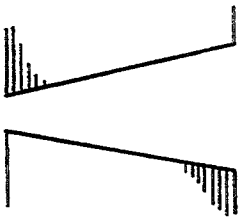

Curve A: the magnetization curve for the core lamination;

Curve B: the magnetization curve for a small air gap distance;

Curve C: the curve resulting from curve A and curve B;

Curve D: the magnetization curve for a large air gap distance;

Curve E: the curve resulting from curve A and curve D;

FIG. 12 a core built up of part cores (1,2,3, . . . , n−1 ,n) partly provided with air gaps:

Part core 1: without air gap

Part core 2: with a small air gap

Part core 3: with a larger air gap

Part core n−1: with two air gaps

Figure 14:
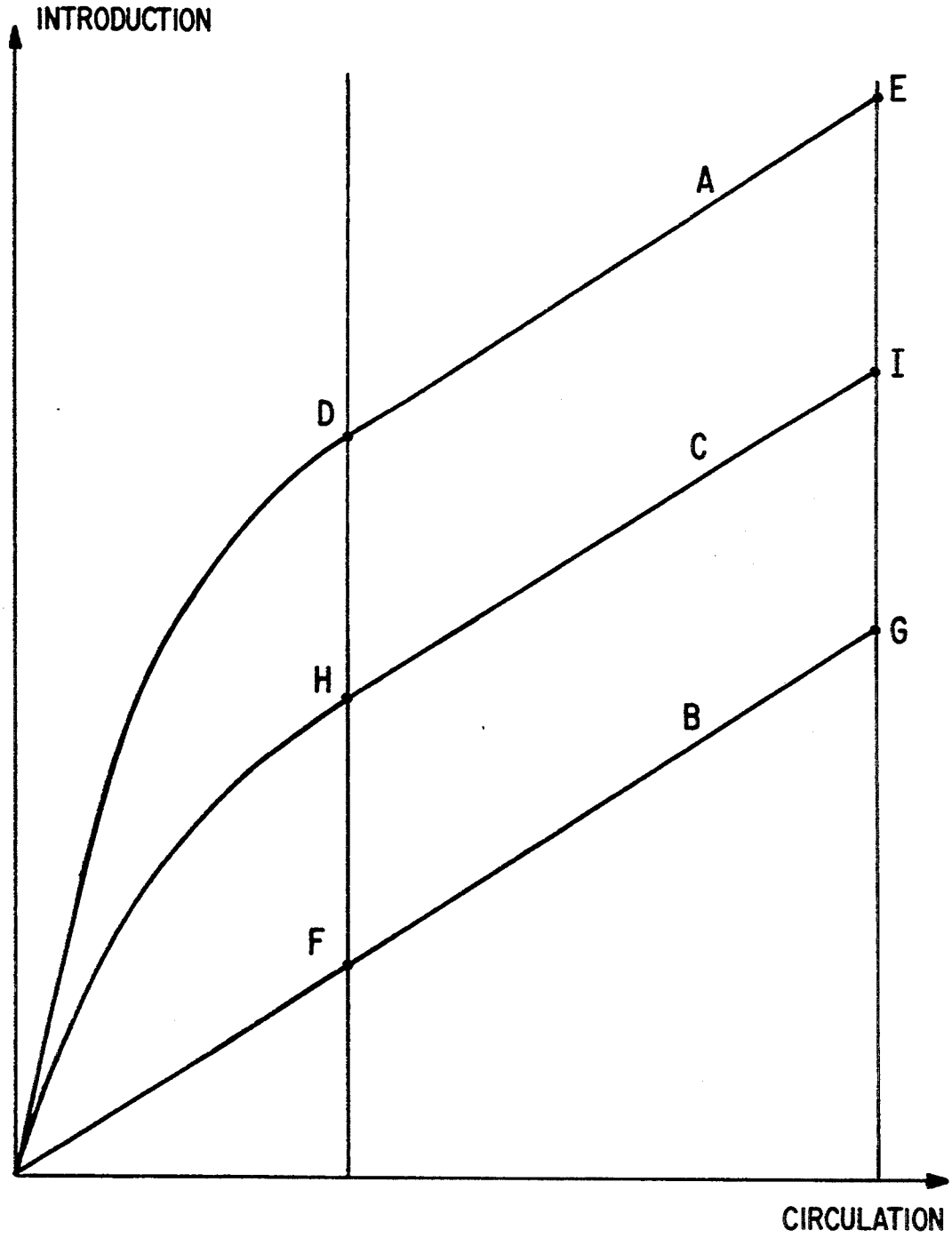

Part core n: with four air gaps:

FIG. 13 Possible shapes of air gaps, with the meanings:

a) parallel air gap b) air gap bevelled downwards c) air gap bevelled upwards d) air gap symmetrically bevelled e) air gap trapeziodal downwards f) air gap trapezoidal upwards g) air gap symmetrically trapezoidal;

FIG. 14 The magnetization curves for two cores with differing magnetic characteristics "Induction as a function of the circulation and the total induction resulting from this":

Curve A: the magnetization curve for the core SK

Curve B: the magnetization curve for the core RK

Figure 15:
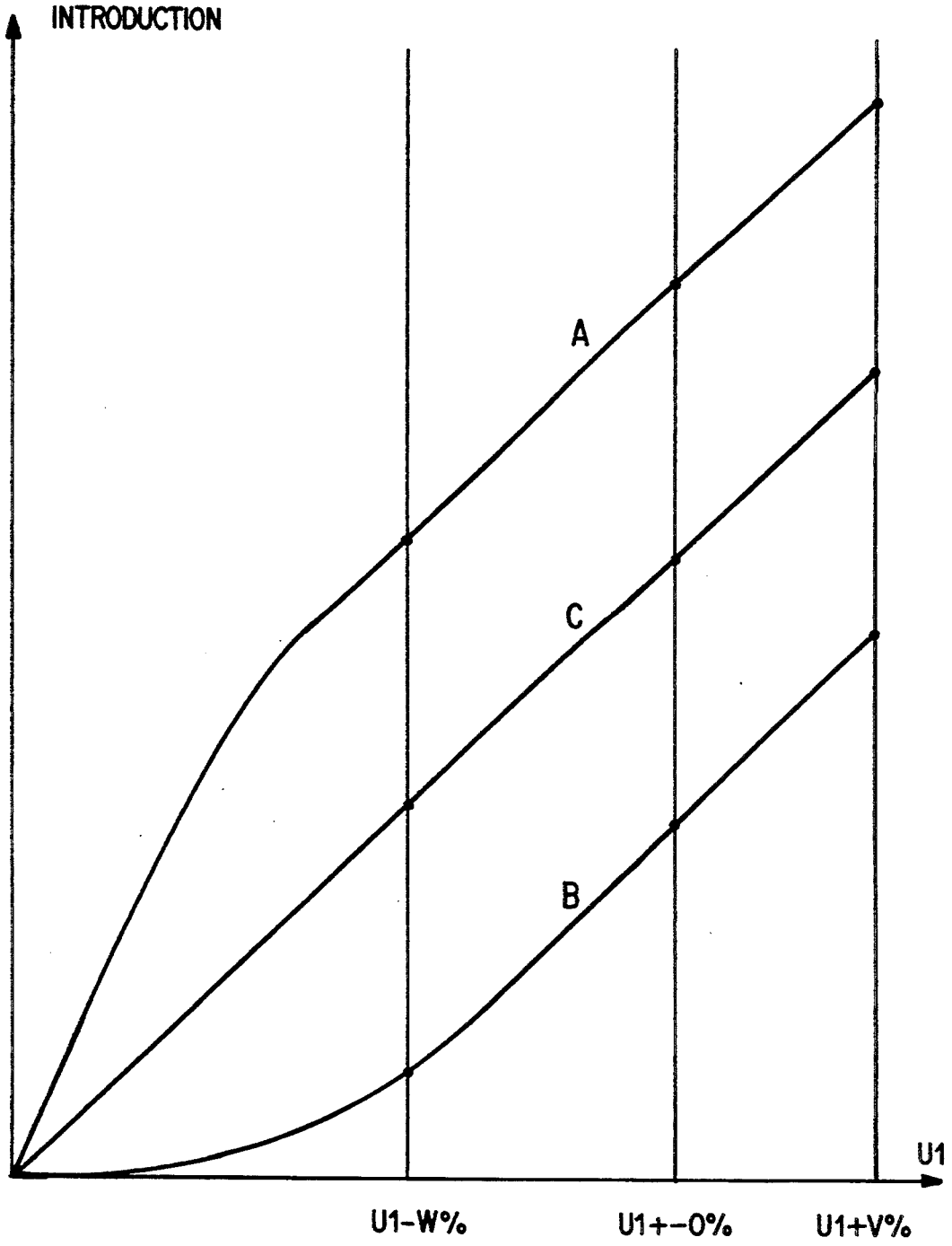

Curve C: the total magnetization curve for both cores SK and RK; FIG. 15 The magnetization curves for two cores with differing magnetic characteristics "Induction as a function of the primary voltage and the total induction resulting from this with identical ascent of the three curves within the specific area of primary voltage":

curve A: the magnetization curve for the core SK

Curve B: the magnetization curve for the core RK

Figure 16:
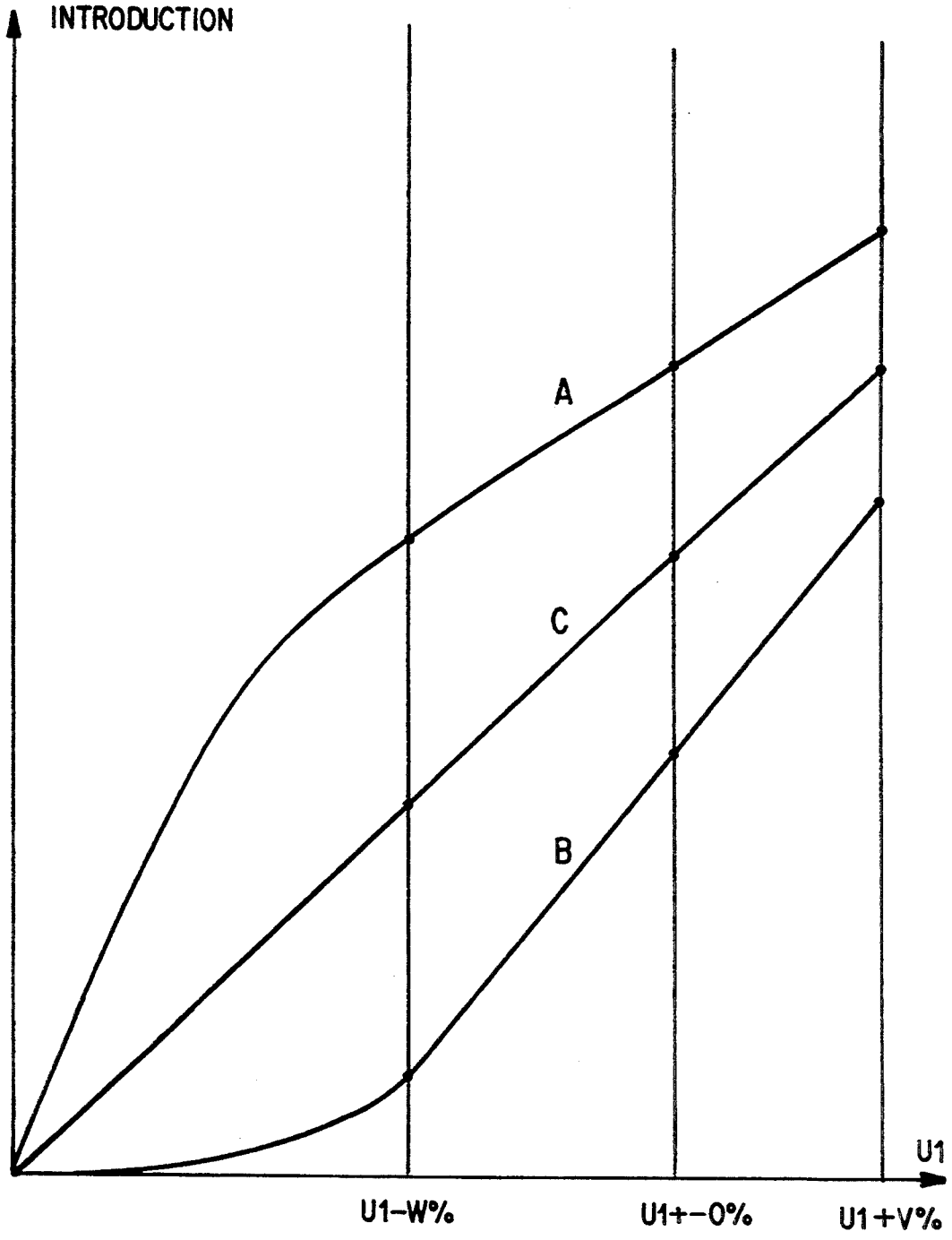

Curve C: the total magnetization curve for both cores SK and RK;

FIG. 16 The magnetization curves for two cores with differing magnetic characteristics "Induction as a function of the primary voltage and the total induction resulting from this with non-identical ascent of the three curves within the specific area of primary voltage":

Curve A: the magnetization curve for the core SK

Curve B: the magnetization curve for the core RK

Curve C: the total magnetization curve for both cores SK and RK;

Curve B having a greater ascent than curve A.

Figure 17:
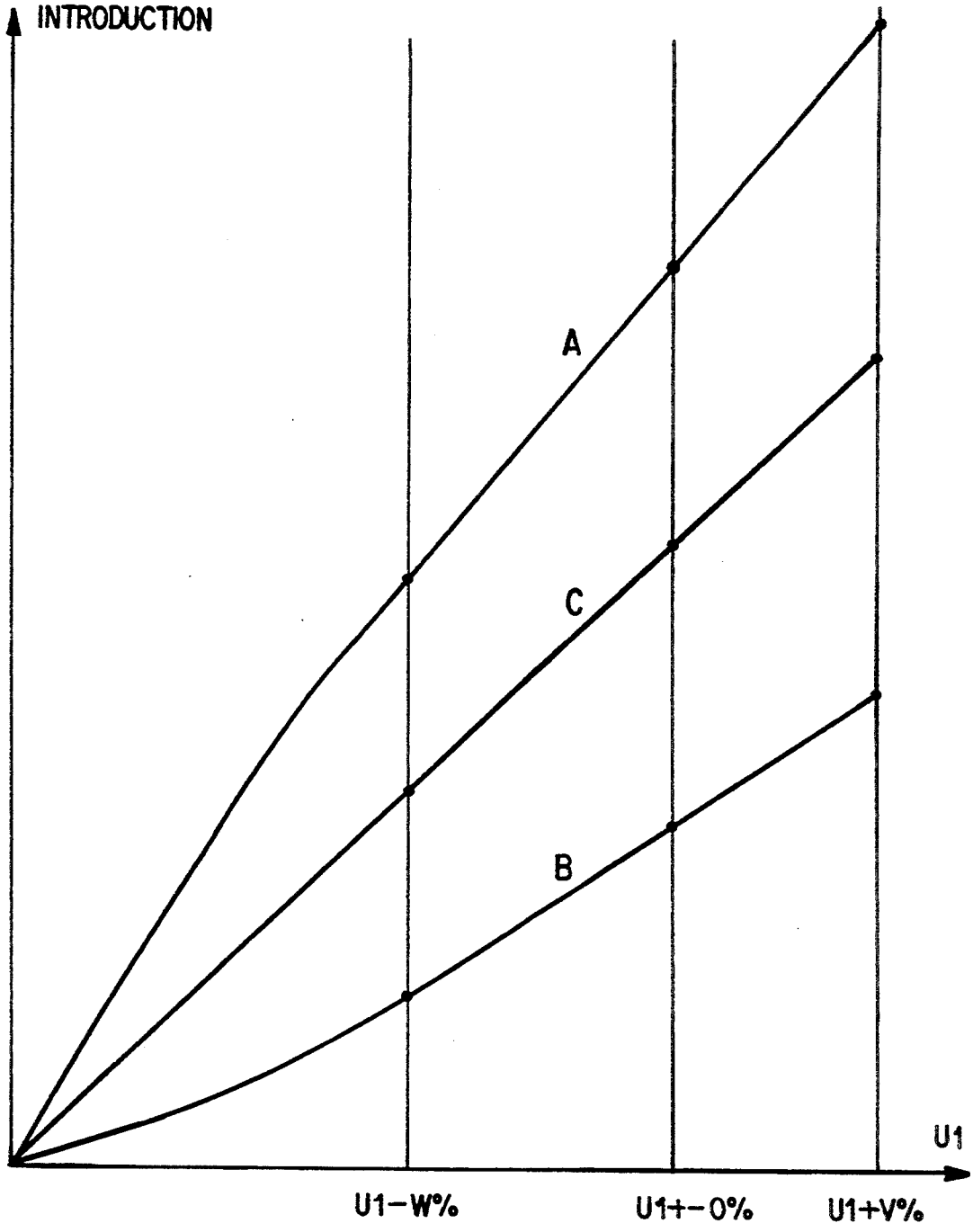

FIG. 17 The magnetization curves for two cores with differing magnetic characteristics "Induction as a function of the primary voltage and the total induction resulting from this with non-identical ascent of the three curves within the specific area of primary voltage":

Curve A: the magnetization curve for the core SK

Curve B: the magnetization curve for the core RK

Figure 8:
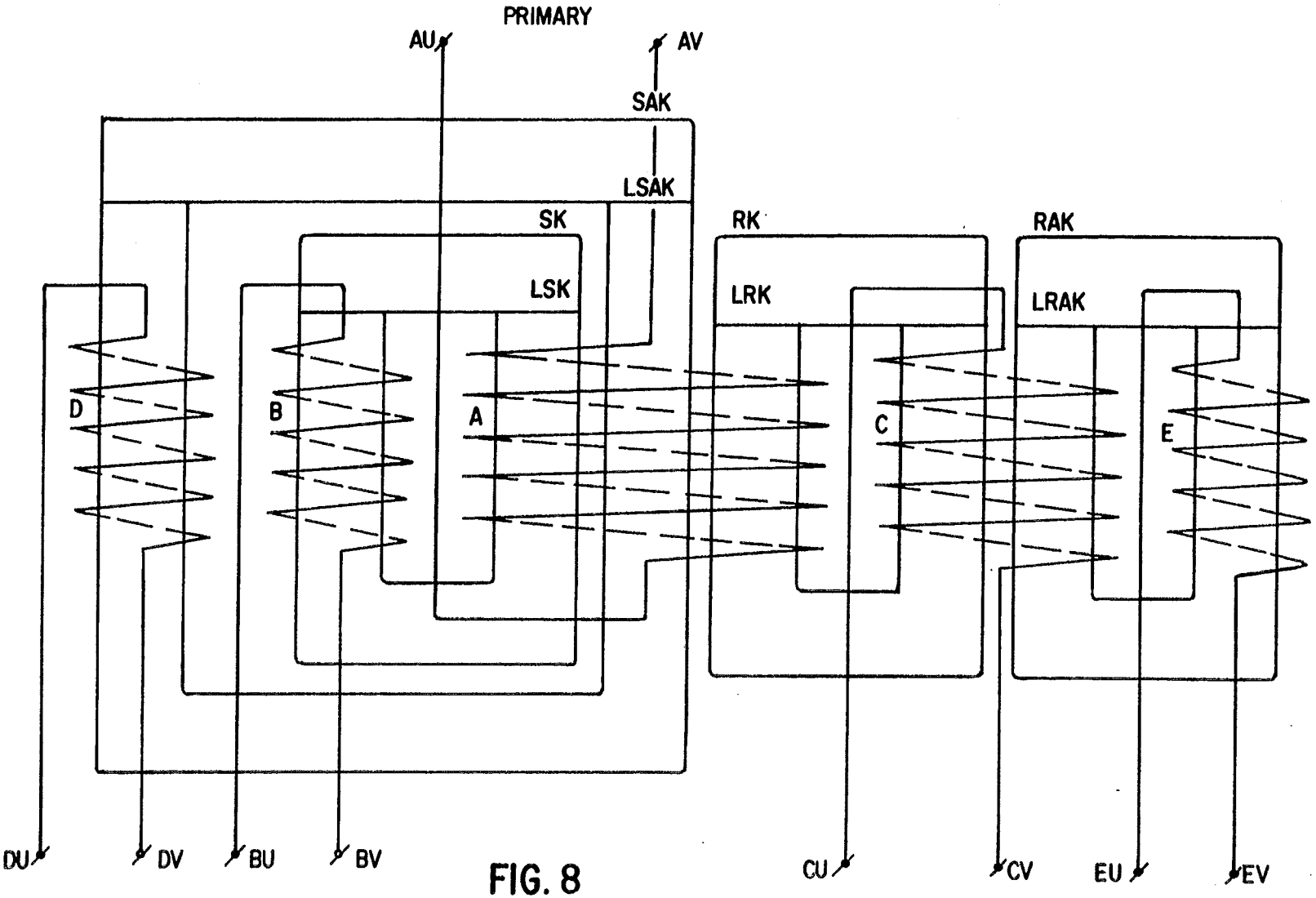
FIG. 8 The principal construction of the delta-phi transformer in an extended form of construction, consisting of the cores SK, RK, SAK and RAK and the coils A, B, C, D and E with the coil A which encloses the cores SK, RK and RAK as primary coil, and the coils B, C, D and E as secondary coils in open circuit.
Figure 9:
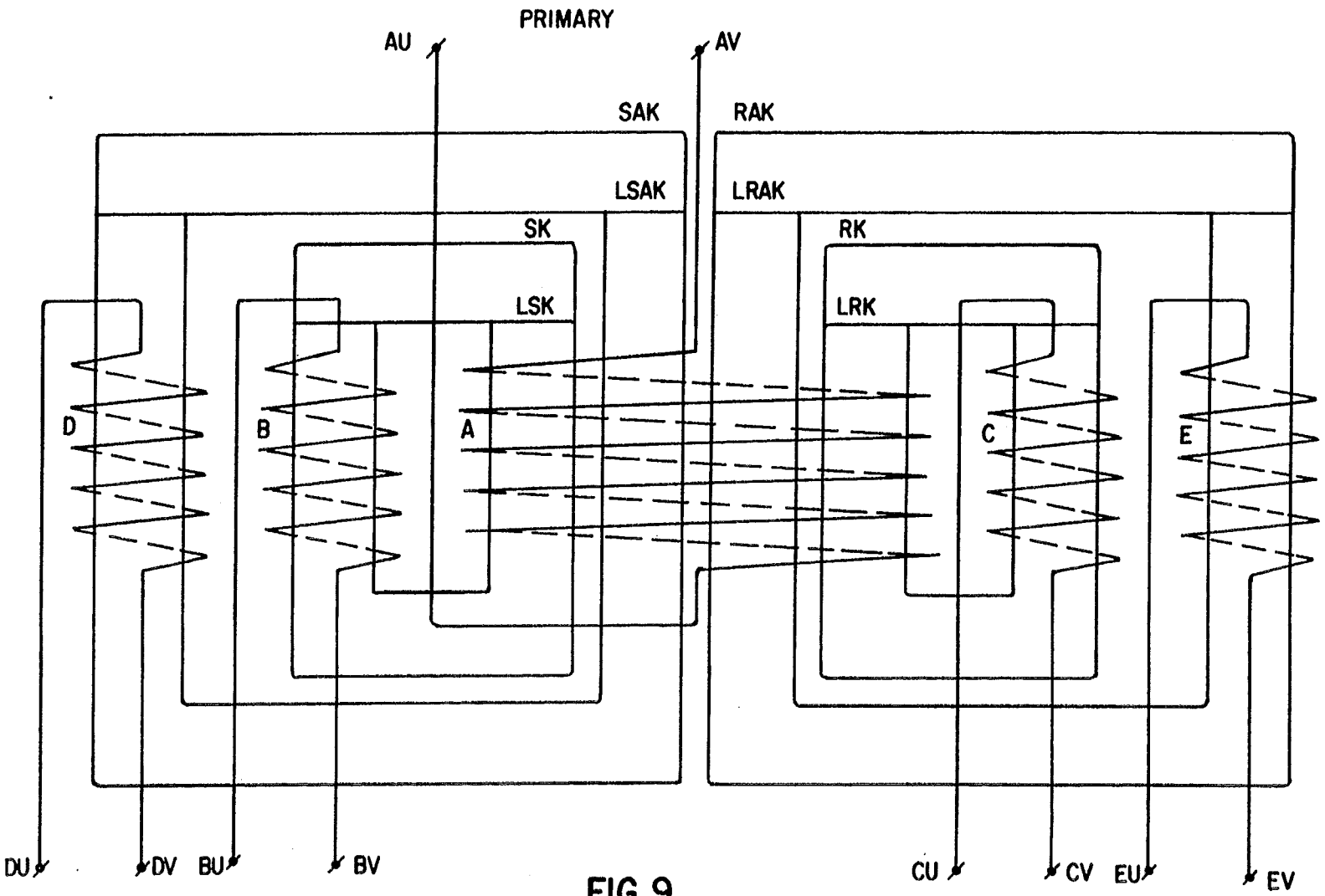
FIG. 9 The principal construction of the delta-phi transformer in an extended form of construction, consisting of the cores SK, RK, SAK and RAK and the coils A, B, C, D and E with the coil A which encloses the cores SK, RK, SAK and RAK as primary coil, and the coils B, C, D and E as secondary coils in open circuit.
Figure 18:
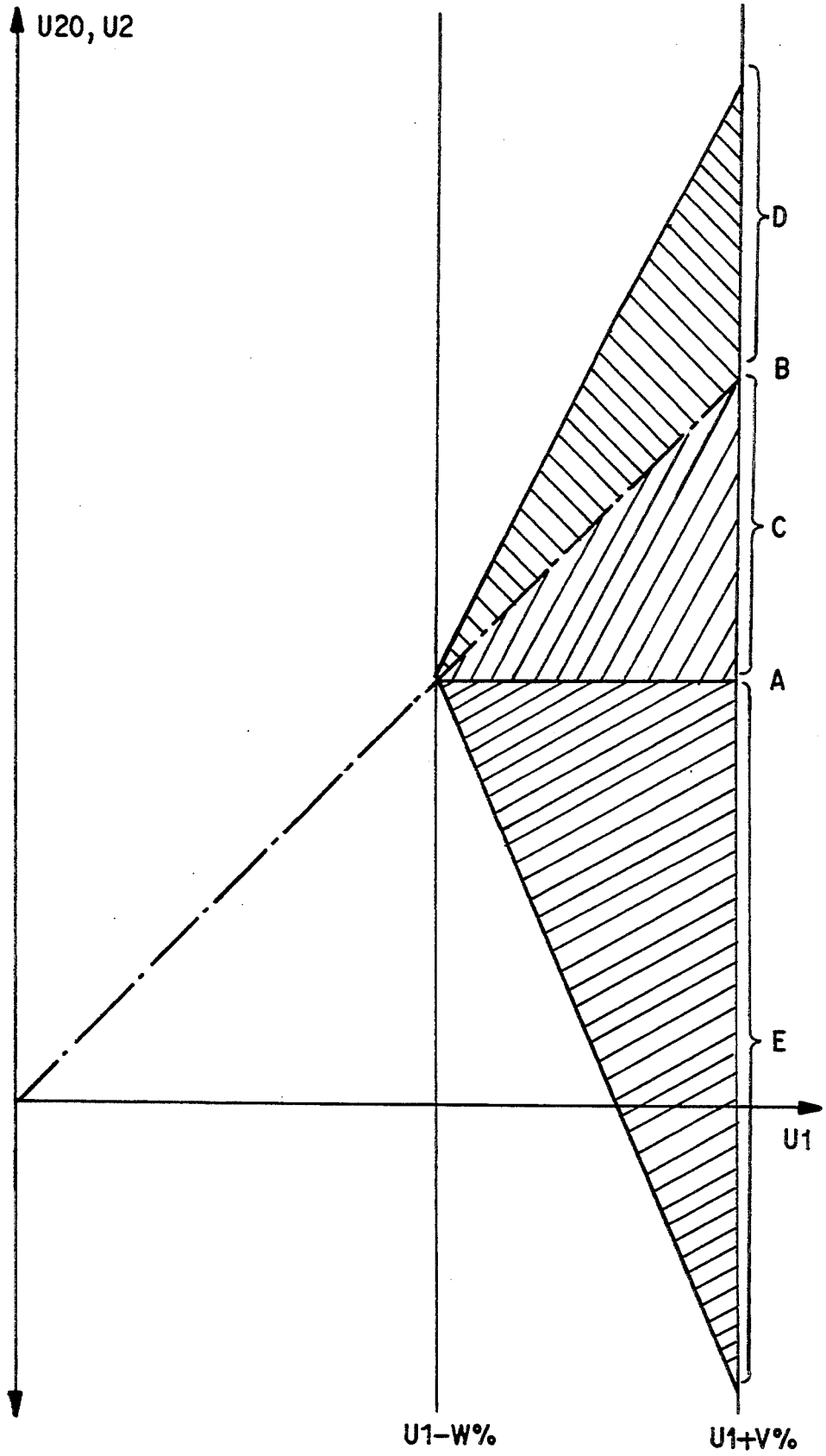
Figure 19:
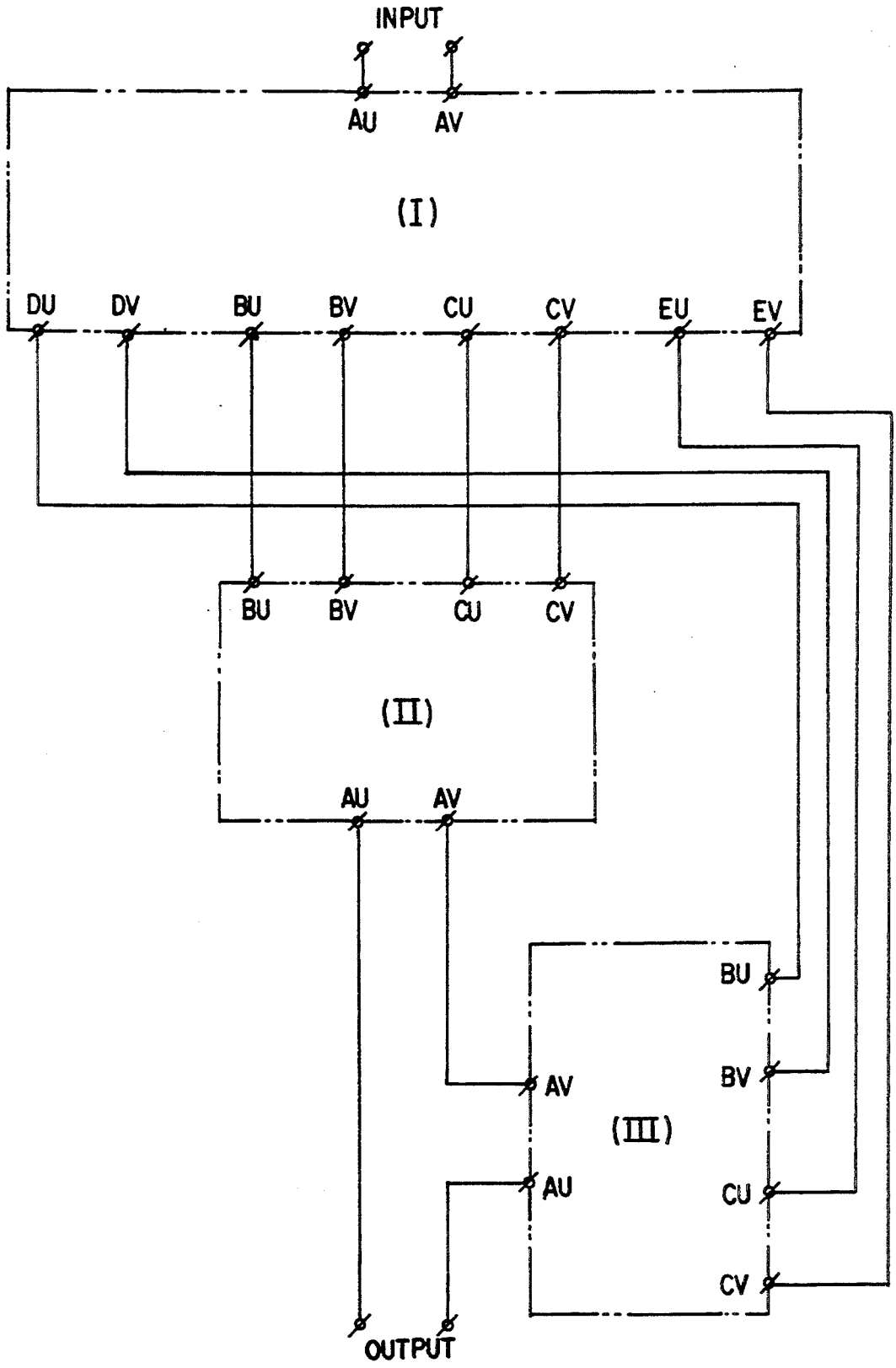

Curve C: the total magnetization curve for both cores SK and RK;

Curve B having a lower ascent than curve A:

FIG. 18 the area of behaviour of the secondary voltage;

FIG. 19 a delta-phi transformer system, consisting of:

I 1 delta-phi transformer according to FIG. 8 or FIG. 9

Figure 6:
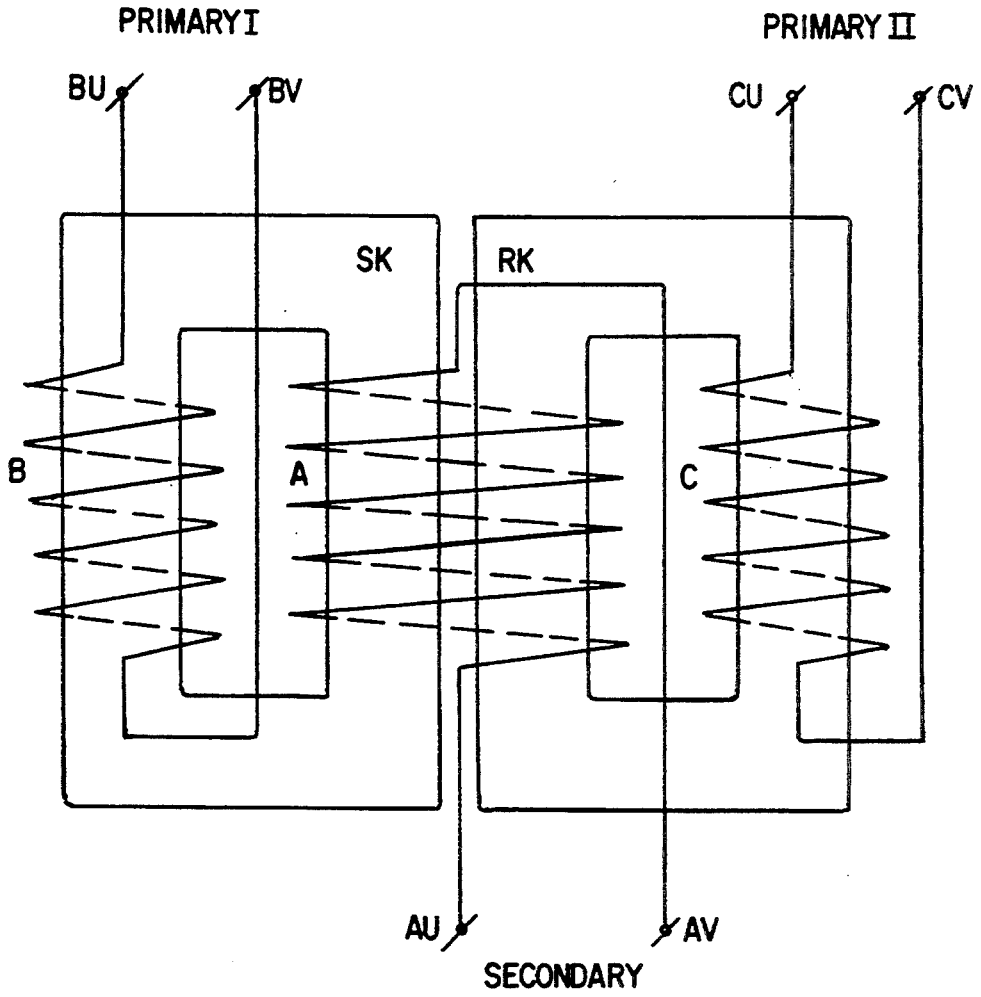
FIG. 6 The principal construction of the delta-phi transformer in an extended form of construction, consisting of the cores SK and RK and the coils A, B and C, with the coils B and C as primary coils.

II 1 delta-phi transformer according to FIG. 6

Figure 7:
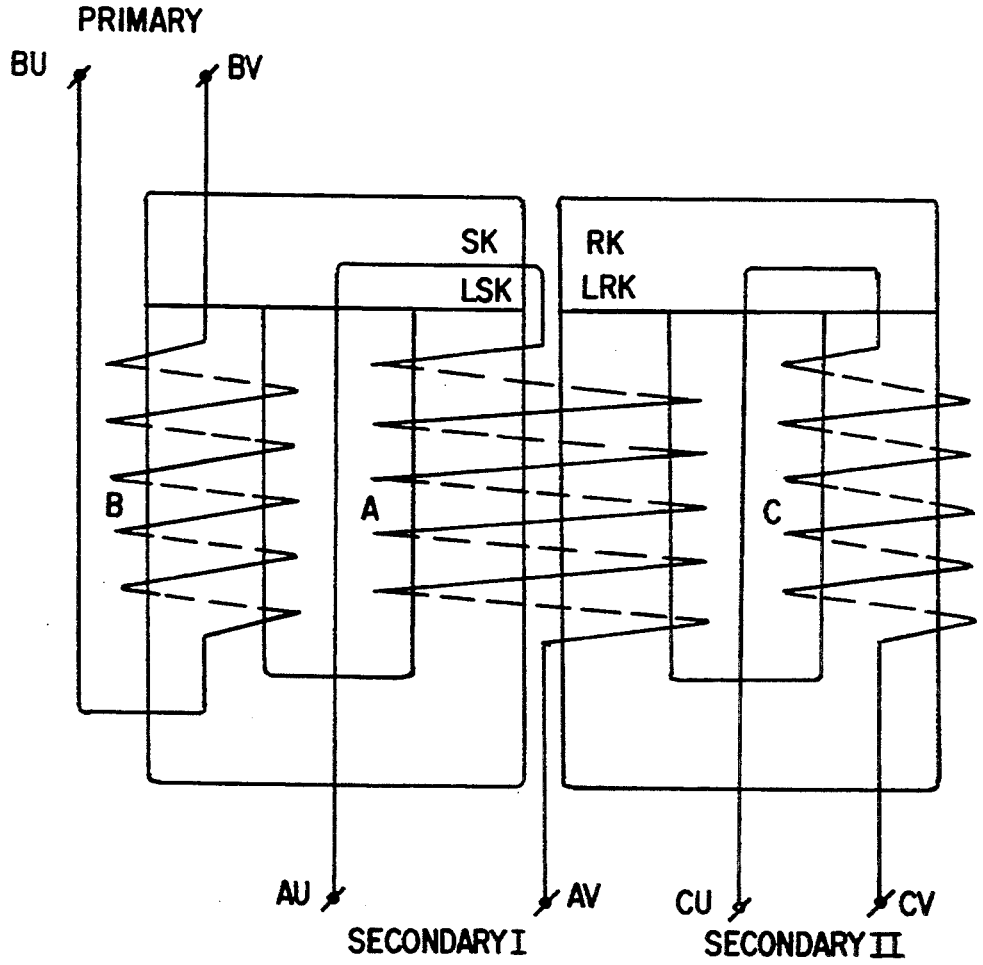
FIG. 7 The principal construction of the delta-phi transformer in an extended form of construction, consisting of the cores SK and RK and the coils A, B and C, with the coil B as primary coil.
Figure 20:
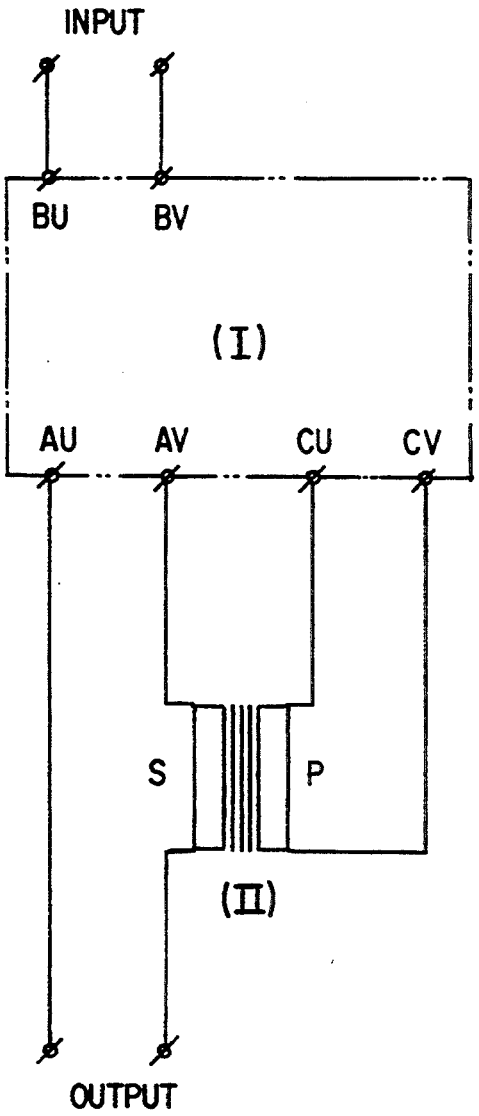

III 1 delta-phi transformer according to FIG. 6 and;

FIG. 20 a delta-phi transformer system, consisting of:

I 1 delta-phi transformer according to FIG. 7

II 1 transformer of conventional construction.

DESCRIPTION OF THE PREFERRED EMBODIMENTS

Before the principal construction and the mode of operation of the delta-phi transformer are dealt with in detail, it must be stated beforehand that it can be operated sensibly in at least three different stages of function, i.e. in primary, secondary and tertiary function.

If the delta-phi transformer is working in primary function, then feeding of electricity comes about directly from a destabilized network. If it is working in secondary function, then the feeding of electricity is carried out onto at least one primary coil from at least one secondary branch of a delta-phi transformer with primary or secondary function, which is connected in series, or directly from a stabilized network. Thus, more than one delta-phi transformer with secondary function can also be connected in series. A transformer with tertiary function can be both a delta-phi transformer and also a transformer of conventional construction. The secondary coil of the transformer with tertiary function is connected in series with the main current secondary coil branch(es) of the delta-phi transformer(s) with primary and/or secondary function. With the transformer in tertiary function, the feeding of electricity is carried out onto at least one primary coil from the induction current secondary coil branches of the delta-phi transformer(s) with primary and/or secondary function(s). The secondary coils of more than one transformer with tertiary functions can be connected in series. Parallel connection or combined connection of the secondary coils of the transformers with tertiary function is also possible.

The function of the delta-phi transformer is based upon a special magnetization effect.

If at least two magnetically separated cores with differing magnetic characteristics are enclosed by a joint magnet coil and the magnet coil is laid onto an increasing voltage, then the no-load current flows in the magnet coil. Due to the fact that these coils are enclosed by the same magnet coil with the corresponding number of turns, the cores have the same magnetic circulation, i.e. the circulation of the one core is the same as the circulation of the other core. As a result of the differing magnetic characteristics, the cores are magnetized differently, i.e. differing magnetic fluxes or inductions are formed in the cores. As the no-load current, from the point of view of the magnet coil, acts on a joint core, put together from the individual cores, the total cross-section of which consists of the total of the individual cores, the corresponding total induction can be determined on the basis of the energizing voltage, the frequency, the number of turns of the magnet coil and the total core cross-section in each energizing voltage. The total induction can also be determined on the basis of the existing magnetization curves "Inductions as a function of the circulation" and the individual core cross-sections. The total induction B is the total of the individual magnetic fluxes divided by the total of the individual core cross-sections. The total induction B determined in this way as a function of the circulation must produce a curve. The modification of the magnetization curve "Induction as a function of the circulation" to the magnetization curve "Induction as a function of the primary voltage" is carried out is such a way that the curve of the total induction B in the magnetization curve "Induction as a function of the circulation" is to be divided up into identical part inductions, which corresponds to the respective part energizer voltages. The inductions of the individual cores above or below the division points also correspond to the part energizer voltages and can be transferred into the new curve "Induction as a function of the primary voltage".

Figure 1:
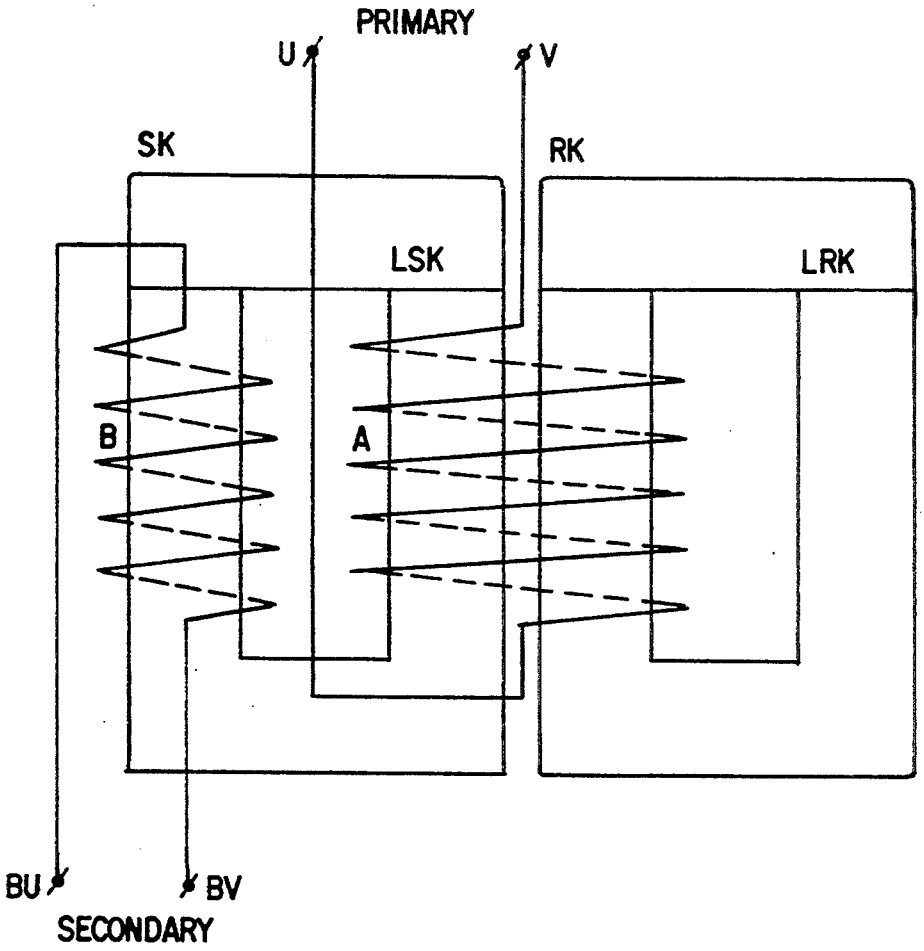
FIG. 1 The principal construction of the delta-phi transformer in its simplest form of construction, consisting of the cores SK and RK and the coils A and B.

In FIG. 1, the simplest version of the delta-phi transformer in accordance with the invention is shown in principle. The transformer has two cores with differing total magnetic effects, viz. the so-called main core SK and the so-called regulating core RK. The primary coil A jointly encloses the two cores SK and RK. The main core SK is also enclosed by a further coil, the main coil B. There is no further coil around the regulating core RK. Due to the fact that the cores have differing total magnetic effects, differing, determinable magnetic fluxes are formed in the cores SK and RK. In this type of delta-phi transformer, only the magnetic flux in the main core SK is used by the coil B.

Figure 2:
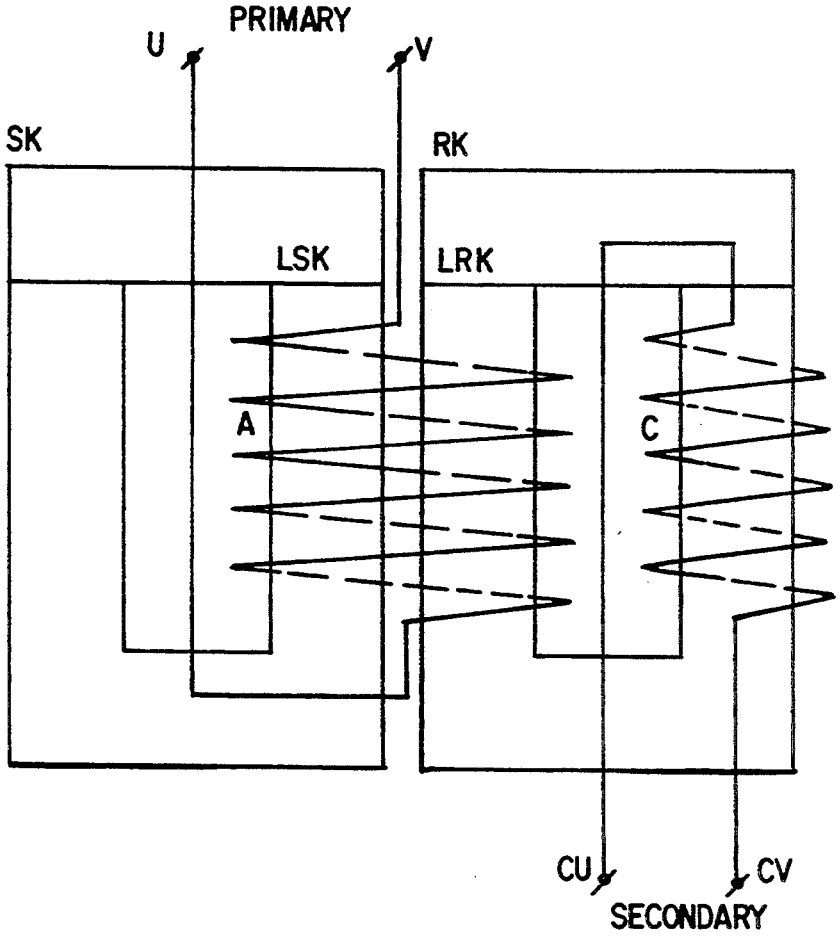
FIG. 2 The principal construction of the delta-phi transformer in its simplest form of construction, consisting of the cores SK and RK and the coils A and C.

In FIG. 2, the simplest version of a delta-phi transformer in accordance with the invention is also shown in principle. As opposed to the version in FIG. 1, only the magnetic flux in the regulating core RK is used by the coil C in this version.

Figure 3:
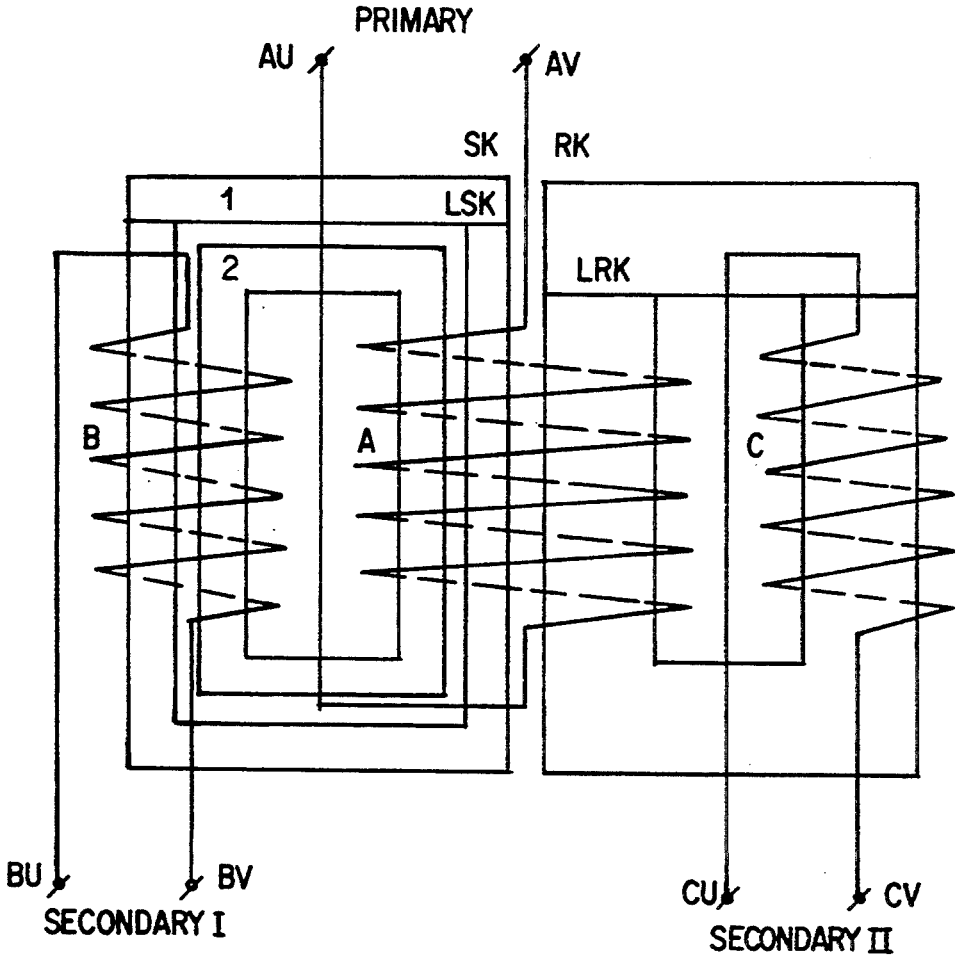
FIG. 3 The principal construction of the delta-phi transformer in an extended form of construction, consisting of the cores SK and RK and the coils A, B and C, the core SK divided into two part cores, with the coil A as primary coil, coils B and C in open circuit.

In FIG. 3, the extended version of a delta-phi transformer is shown in principle. The transformer has two cores with differing total magnetic effects, viz. the main core SK, which is divided into two part cores 1 and 2 with different total magnetic effects. As opposed to part core 1, part core 2 has an air gap LSK. The regulating core RK also has an air gap. Coil A, in the function of the primary coil, encloses both the cores SK and RK.

Coil B is on the main core SK and coil C on the regulating core RK, and they represent secondary coils in open circuit. This version is mainly used for the delta-phi transformers in primary function. Due to the corresponding connection of the secondary coils, either additive connection in series, i.e. the voltages induced in coils B and C are added, substractive connection in series, i.e. the voltage induced in coil C is subtracted from the voltage induced in coil B, or open circuit, all determinable secondary voltage behaviours can be produced. The voltages induced in coils B and C or the number of turns needed for these coils can be calculated in accordance with the law of transformation, according to which the calculation for both cores is to be carried out both at the upper and at the lower limit of the area of primary voltage.

Figure 4:
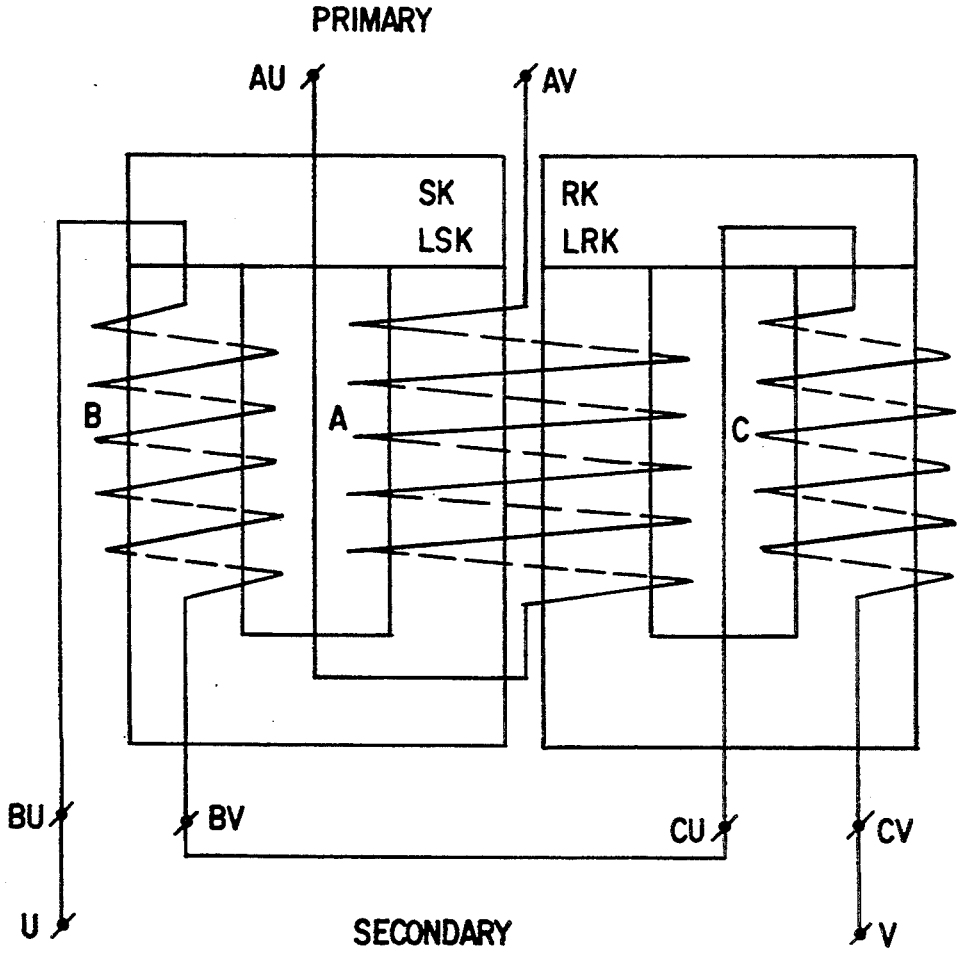
FIG. 4 The principal construction of the delta-phi transformer in an extended form of construction, consisting of the cores SK and RK and the coils A, B and C, the core SK divided into two part cores, with the coil A as primary coil and additive series connection of the coils B and C.

FIG. 4 also shows a delta-phi transformer with two magnetically separated cores SK and RK with different total magnetic effects, with the primary coil A, which jointly encloses the two cores SK and RK, coil B, which is on the core SK, and coil C, which is on core RK. The coils B and C are secondary coils and are connected in series additively.

Figure 5:
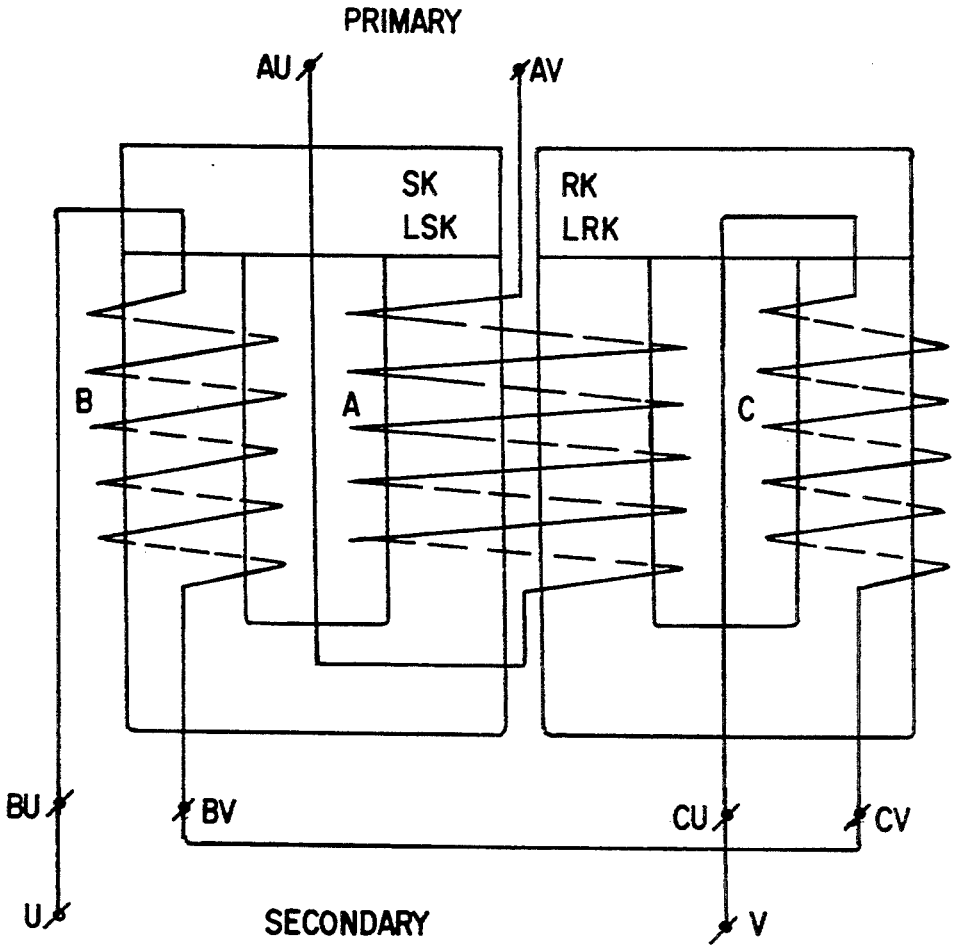
FIG. 5 The principal construction of the delta-phi transformer in an extended form of construction, consisting of the cores SK and RK and the coils A, B and C, the core SK divided into two part cores, with the coil A as primary coil and subtractive series connection of the coils B and C.

FIG. 5 shows the same delta-phi transformer as is shown in FIG. 4, only with subtractive connection in series of the coils B and C.

FIG. 6 shows the delta-phi trafo with two magnetically separated cores SK and RK with identical total magnetic effects, with the coil A, which jointly encloses the two cores, as a secondary coil, coil B, which is on the main core SK, and coil C, which is on the regulating core RK. The coils B and C are primary coils. This version is mainly used for a delta-phi transformer with secondary or tertiary function. When this version is used as a delta-phi transformer with secondary function, the connections with the corresponding coils of the delta-phi transformer in circuit are to be carried out in such a way that the magnetic fluxes built up in the cores SK and RK of the delta-phi transformer with secondary function have an additive or subtractive effect on coil A. The same is also true for the delta-phi transformer with tertiary function.

FIG. 7 shows the principal construction of a delta-phi transformer with two magnetically separated cores SK and RK with differing total magnetic effects. The coil A jointly encloses the two cores SK and RK and has the function of the main secondary coil. Coil B is on the main core SK as a primary coil, and coil C is on the regulating core RK as a subsidiary secondary coil. This version is mainly used for the delta-phi transformer with direct feeding from a stabilize network. Coil A is to be dimensioned in this case, as far as the number of turns is concerned, for the secondary no-load voltage required. In no-load operation, no current flows through coil A. Correspondingly, no magnetic field is built up in the regulating core RK. If the main secondary circuit is loaded, then the secondary current flows in coil A and produces, together with the number of turns of coil A, the corresponding circulation for the regulating core RK. Depending upon the magnetic set-up of the regulating core RK, a corresponding magnetic field is built up in it, which is evaluated in coil C. The voltage induced in coil C is fed to the transformer on the outlet side with tertiary function as primary voltage.

FIG. 8 shows the principal construction of an extended delta-phi transformer with the main core SK, the regulating core RK, the main compensatory core SAK and the regulating compensatory core RAK with differing total magnetic effects. The primary coil A encloses the cores SK, RK and SAK, coil B is on the main core SK, coil C is on the regulating core RK and the regulating compensatory core RAK, coil D is on the main compensatory core SAK and coil E is on the regulating compensatory core RAK. The coils B, C, D and E are secondary coils, and certain functions are allocated to them according to the electrical and magnetic set-up. This version is used for a delta-phi transformer with primary function.

FIG. 9 also shows the principal construction of an extended delta-phi transformer with the main core SK, the regulating core RK, the main compensatory core SAK and the regulating compensatory core RAK with differing total magnetic effects. The primary coil A encloses the cores SK, RK, SAK and RAK. The coil B is on the main core SK, the coil C on the regulating core RK, coil D is on the main compensatory core SAK and the coil E is on the regulating compensatory core RAK. The coils B, C, D and E are secondary coils, and certain functions are allocated to them in accordance with the electrical and magnetic set-up. This version is used for a delta-phi transformer with primary function.

Figure 10:
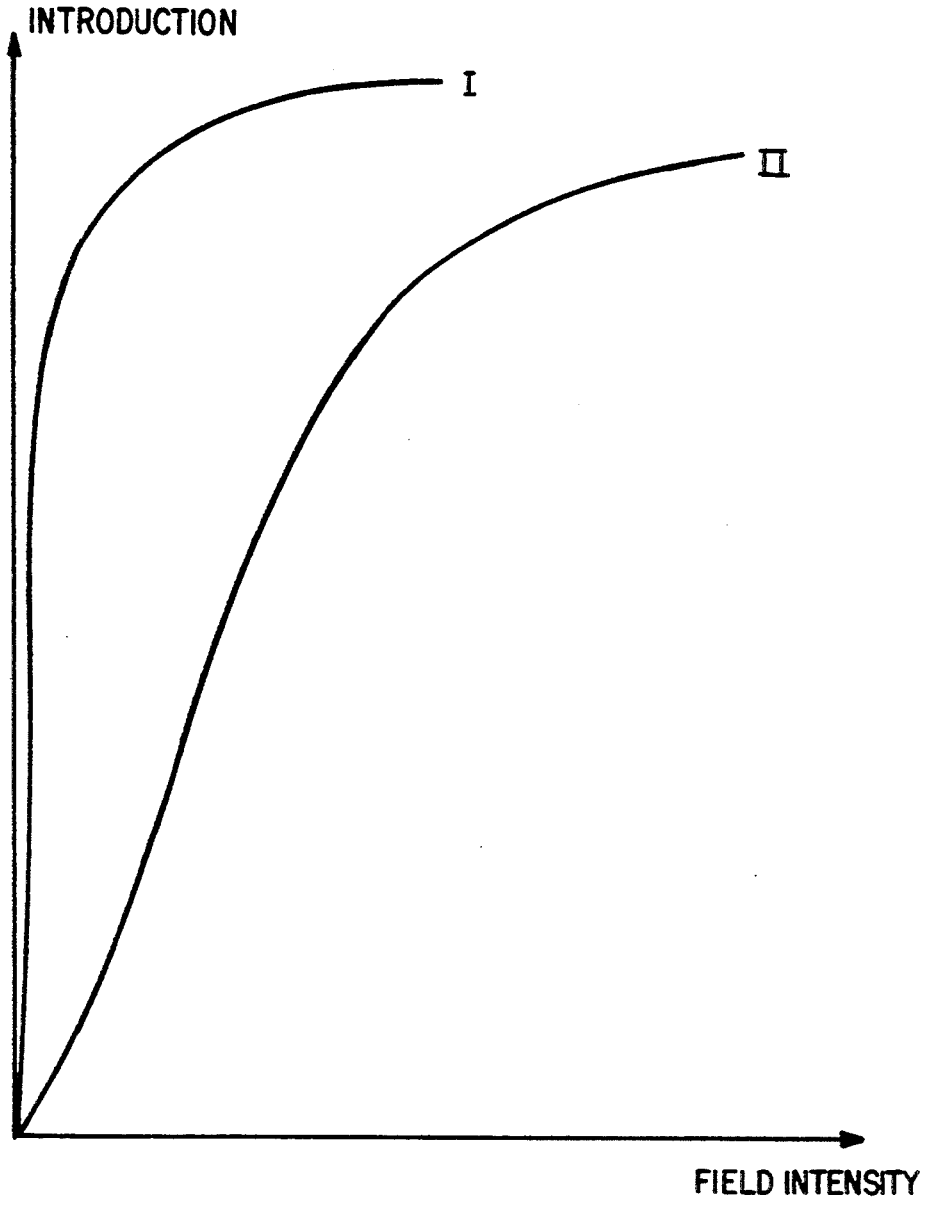
FIG. 10 The magnetization curves "Induction as a function of the field intensity for two different materials"
Figure 11:
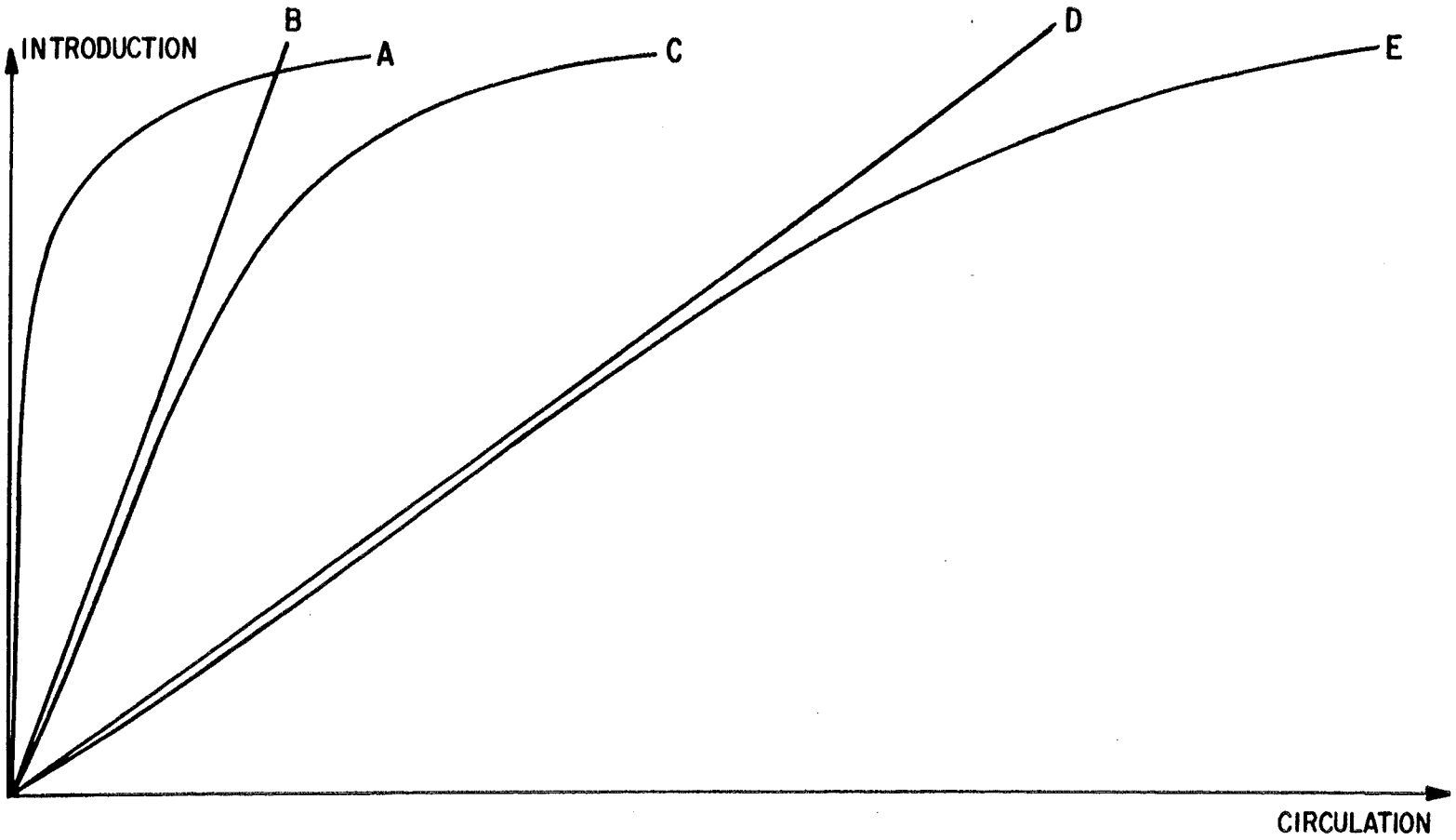
FIG. 11 The influence of the air gap distance on the magnetization curves "Induction as a function of the circulation"

FIG. 12 shows a core split up into part cores with differing total magnetic effects. The differing total magnetic effects are achieved by part core 1 having no air gap and the other part cores having differing air gaps. The shapes of air gaps used are shown in FIG. 13. The magnetic characteristics in the individual part cores 1, . . . , n are influenced according to FIGS. 10 and 11. The magnetic lines of force spread in the zones of the air gaps. So that the part cores do not magnetically influence one another, the individual part cores are to be at a distance from one another corresponding to that of the largest adjacent air gap.

As can be seen from FIG. 14, the magnetization curve "Induction as a function of the circulation" for curve A between points D and E must correspondingly be a straight line. The same is also correspondingly true for curve B for the regulating core RK between the points F and G. Likewise, the curve C must also correspondingly be a straight line jointly for both cores SK and RK between the points H and I. The points D, F and H are thus the lower limits for the specific primary voltage area and the points E, G and I are the upper limits. The points H and I on the curve C must be selected in such a way that the inductions at these points correspond to the lower and upper limits of the specific primary voltage area in accordance with the law of transformation.

According to FIGS. 15 to 17, the total magnetization curve c is correspondingly always a straight line jointly for the two cores SK and RK in accordance with the law of transformation $U=4.44\times f\times w\times A\times B\times 10{,}000$ for B in Tesla. This straight line is to be divided into equal parts, the corresponding inductions are to be determined and to be transferred into the curve C of the magnetization curve "Induction as a function of the circulation" in accordance with FIG. 14, whereby the existing circulation values are determined with the corresponding inductions of the curve C. The appropriate inductions for the curves A and B are thus also determined and are to be transferred into the magnetization curves "Induction as a function of the primary voltage".

The total magnetization curves "Induction as a function of the circulation" and "Induction as a function of the primary voltages" are to be determined by use of the same method for one of the cores divided into part cores with differing magnetic characteristics in accordance with FIG. 12.

FIG. 18 shows the areas of the kinds of behaviour of the secondary voltage. The horizontal line A means constant, the dotted line B an equal percentage, the shaded area C a smaller percentage, the shaded area D a larger percentage and the shaded area E negative, the secondary voltage increases with an increase in the primary voltage or the secondary voltage decreases with a decrease in the primary voltage, course of the secondary voltage as a function of the alteration of the primary voltage from $U1+v$ % to $U1-w$ %.

FIG. 19 shows the connection of a delta-phi transformer system with a delta-phi transformer with primary function in accordance with FIG. 8 or FIG. 9, a delta-phi transformer with secondary function according to FIG. 6 and a delta-phi transformer with tertiary function according to FIG. 6. With corresponding dimensioning of the individual delta-phi transformers, all kinds of behaviour of the secondary voltage can be achieved with this delta-phi transformer system.

FIG. 20 shows the connection of a delta-phi transformer system with a delta-phi transformer with secondary function according to FIG. 7 and a transformer of conventional construction with tertiary function. The feeding of electricity for this delta-phi transformer system comes directly from a stabilized network.

I claim:

1. A transformer with at least three cores separated from one another, each forming a magnetic circuit, a first coil which winds around at least two of said cores, and at least a second coil, at least one of the cores being looped by both the first as well as the second coil, at least one of the cores which are looped by the first coil having an air gap, wherein at least two of the cores enclosed by the first coil have differing magnetic characteristics, the resulting magnetic characteristic of these two cores being different from the magnetic characteristic of at least the third core, and wherein the second coil also winds around at least two cores.

2. A transformer according to claim 1, further comprising at least a third coil which winds around at least one of the cores.

3. A transformer according to claim 1, wherein adjacent cores, of which one has at least one air gap, are separated from each other by at least the distance of the air gap when only one of said cores has an air gap, and of the larger air gap if each of the adjacent cores has an air gap.

4. A transformer according to claim 2, wherein adjacent cores, of which one has at least one air gap, are separated from each other by at least the distance of the air gap when only one of said cores has an air gap, and of the larger air gap if each of the adjacent cores has an air gap.

5. A transformer according to claim 1, wherein at least two coils are connected to each other in series such that the voltages induced therein subtract.

6. A transformer according to claim 2, wherein at least two coils are connected to each other in series such that the voltages induced therein subtract.

7. A transformer according to claim 3, wherein at least two coils are connected to each other in series such that the voltages induced therein subtract.

8. A transformer according to claim 1, wherein at most one of the cores which is wound by the first coil has no air gap.

9. A transformer according to claim 2, wherein at most one of the cores which is wound by the first coil has no air gap.

10. A transformer according to claim 3, wherein at most one of the cores which is wound by the first coil has no air gap.

11. A transformer according to claim 4, wherein at most one of the cores which is wound by the first coil has no air gap.

12. A transformer according to claim 5, wherein at most one of the cores which is wound by the first coil has no air gap.

13. A transformer according to claim 6, wherein at most one of the cores which is wound by the first coil has no air gap.

14. A transformer according to claim 7, wherein at most one of the cores which is wound by the first coil has no air gap.

* * * * *